US005733025A

United States Patent [19]

Jesse, Sr.

[11] Patent Number: 5,733,025

[45] Date of Patent: Mar. 31, 1998

[54] COMPUTER MONITOR STAND

[76] Inventor: Michael D. Jesse, Sr., 10024 S. Ross, Oklahoma City, Okla. 73159

[21] Appl. No.: 716,979

[22] Filed: Sep. 20, 1996

Related U.S. Application Data

[60] Provisional application No. 60/014,405, Mar. 29, 1996.

[51] Int. Cl. [6] ..... A47B 97/00; A47F 7/00

[52] U.S. Cl. ..... 312/223.3; 312/107; 108/90; 248/918; 211/11

[58] Field of Search ..... 312/223.3, 223.1, 312/223.2, 351, 107, 111; 108/90, 157, 97; 248/918, 917, 551; 211/11

[56] References Cited

U.S. PATENT DOCUMENTS

| | | | |
|---|---|---|---|
| 1,303,985 | 5/1919 | Straubel | 312/107 X |
| 3,133,771 | 5/1964 | Dorman | 312/107 |
| 3,529,878 | 9/1970 | Blowers | 312/111 |
| 4,074,810 | 2/1978 | Juergens et al. | 211/11 |
| 4,679,818 | 7/1987 | Kakavas | 108/90 X |
| 4,735,471 | 4/1988 | Riggsby | 312/312 |
| 4,887,724 | 12/1989 | Pielechowski et al. | 211/11 |
| 4,896,926 | 1/1990 | Verholt | 312/111 |
| 4,966,342 | 10/1990 | Noguera | 248/918 X |
| 5,044,284 | 9/1991 | Gnoss | 312/223.3 X |
| 5,588,727 | 12/1996 | D'Agaro et al. | 312/223.3 X |
| 5,595,074 | 1/1997 | Munro | 248/551 X |
| 5,642,923 | 7/1997 | Meacham et al. | 108/90 X |
| 5,651,524 | 7/1997 | Calfee | 248/918 X |

*Primary Examiner*—Jose V. Chen
*Assistant Examiner*—James O. Hansen
*Attorney, Agent, or Firm*—Robert K. Rhea

[57] ABSTRACT

A selectable height computer monitor stand is formed by one or a plurality of rectangular rigid spacers underlying a top secured to at least one of the spacers by bolts extending through lateral edges of the top and respective end portions of a clamp plate laterally projecting through one of the spacers. The stand height is increased or decreased by inserting or removing additional spacers under the primary monitor stand.

8 Claims, 2 Drawing Sheets

COMPUTER MONITOR STAND

This application claims the benefit of U.S. Provisional Application No. 60/014,405, filed Mar. 29, 1996.

BACKGROUND OF THE INVENTION

1. Field of the Invention

This invention relates to computers and more particularly to vertically stackable components for supporting a monitor at a desired elevation above a platform or table.

2. Description of the Prior Art.

Computer monitors are used in many different environments and it is sometimes difficult to find a table or stand for supporting the monitor at a selected elevation for the reason most monitor desks or computer desks or tables are of such size that a small work space has insufficient room to accommodate the commercially available monitor stand. This invention provides a monitor stand occupying very little more horizontal space than the monitor itself and may be adjusted to substantially any height desired.

The prior art discloses a plurality of patents which disclose stackable containers or drawers for holding certain articles or forming articles of furniture.

U.S. Pat. No. 3,133,771 issued May 19, 1964 to Dorman discloses a housing containing a plurality of drawers subdivided into small compartments to contain bolts, nuts, washers, cotter pins, ect. U.S. Pat. No. 3,529,878 issued Sep. 22, 1970 to S. O. Blowers for Case For Storing Articles similarly discloses a plurality of box-like housing units which may be stacked in locked relation with each unit containing a drawer for receiving articles to be stored. U.S. Pat. No. 4,896,926 issued Jan. 30, 1990 to Verholt for Stackable Drawer Box discloses a plurality of drawers having cooperating coupling elements at respective corners so that when one drawer is placed over a lower drawer the coupling elements engage in locking relation and maintain and the drawers in vertical alignment. These drawer units can be used as for example, a filing cabinet.

The state-of-the-art is believed represented by U.S. Pat. No. 4,735,471 issued Apr. 5, 1988 to Rigsby for Adjustable Height Bookcase. This patent discloses a library type bookcase base having a plurality of shelving units arranged between uprights extending above the base forming vertical spaced shelving accommodating different or similar height books. U.S. Pat. No. 5,147,120 issued Sep. 15, 1992 to Ray for Stackable Bureau and Rack Furniture similarly discloses modular units having multiple drawer or shelf rack sections arranged in vertically stacked relation by brace legs at respected corners of each unit cooperatingly received by an underlying unit.

This invention is distinctive over these and other similar patents by utilizing prior art top and front open rectangular paper holding trays formed from rigid plastic material having hand grip openings in opposite side walls which may be arranged in vertically stacked relation providing a forward opening at each drawer elevation for access to contents of the respective tray. These trays may be rigidly connected to form a monitor supporting platform of selected height having a mouse pad projecting from each lateral side of the platform.

SUMMARY OF THE INVENTION

A self supporting upright rigid computer monitor support or stand is formed by one or a plurality of hollow rectangular spacers of uniform thickness. A platform or top overlies the spacer and is secured thereto at respective lateral edge portions by bolts extending vertically between the top and a horizontal clamp plate extending transversely through and beyond the respective sides of the spacer.

A keyboard pad interposed between the top platform and the clamp plate is movable to extend forwardly of the top. A right or left mouse pad, or both, is rigidly secured at one lateral side edge on the outwardly projecting end portion of the top clamp plate. The vertical height of the monitor stand may be increased by similarly inserting one, two or more additional rectangular spacers similarly secured to the top clamp plate by elongated anchor bolts.

The principal object of this invention is to provide a kit for economically constructing a computer monitor stand of a selected height which includes a keyboard support and right and left hand mouse pads.

DESCRIPTION OF THE PREFERRED EMBODIMENTS

Figure 1:
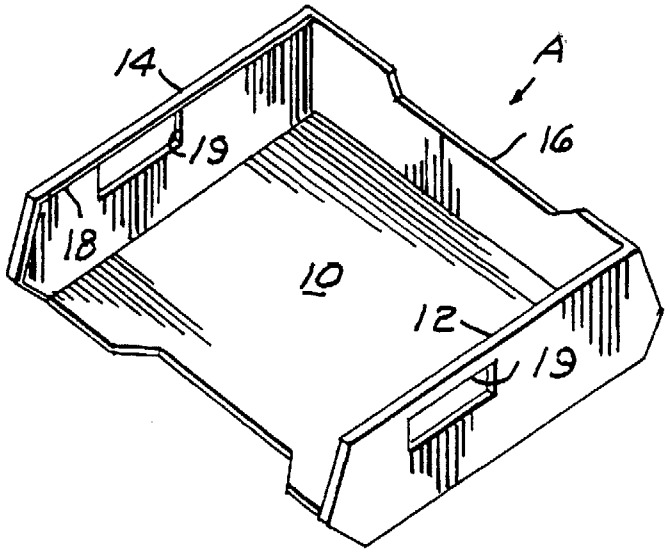
FIG. 1 PRIOR ART
FIG. 1 is a perspective view of a prior art paper tray.

Like characters of reference designate like parts in those figures of the drawings on which they occur.

In the drawings:

The monitor stand 20 includes one or a plurality (2 or 3) prior art identical open top and front rectangular stackable paper holding trays A, B and C each approximately 10.16 cm (four inches) in overall depth, as will now be described.

Referring first to FIG. 1, since the trays are all identical, only the primary tray A is described in detail. The tray A comprises a horizontal bottom 10 having upstanding side walls 12 and 14 interconnected with a back wall 16 all of uniform thickness terminating upwardly in a horizontal plane. The side walls 12 and 14, at their respective forward and rearward ends, project beyond the front to back limit of the bottom wall 10 and the vertical plane of the back wall 16. The top and upper forward edge of the side walls are provided with a coextensive lip 18, turned inwardly a distance at least twice the wall thickness for adding rigidity to the tray. Additionally, the side walls 12 and 14 are each provided with a rectangular horizontal hand grip opening 19 adjacent their upper limit. Each side wall opening 19 is transversely aligned with the opening in the opposite wall.

Figure 4:
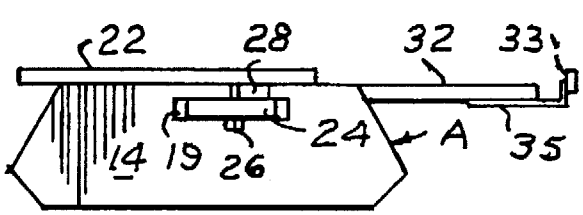
FIG. 4 is a left side elevational view of FIG. 2.
Figure 2:
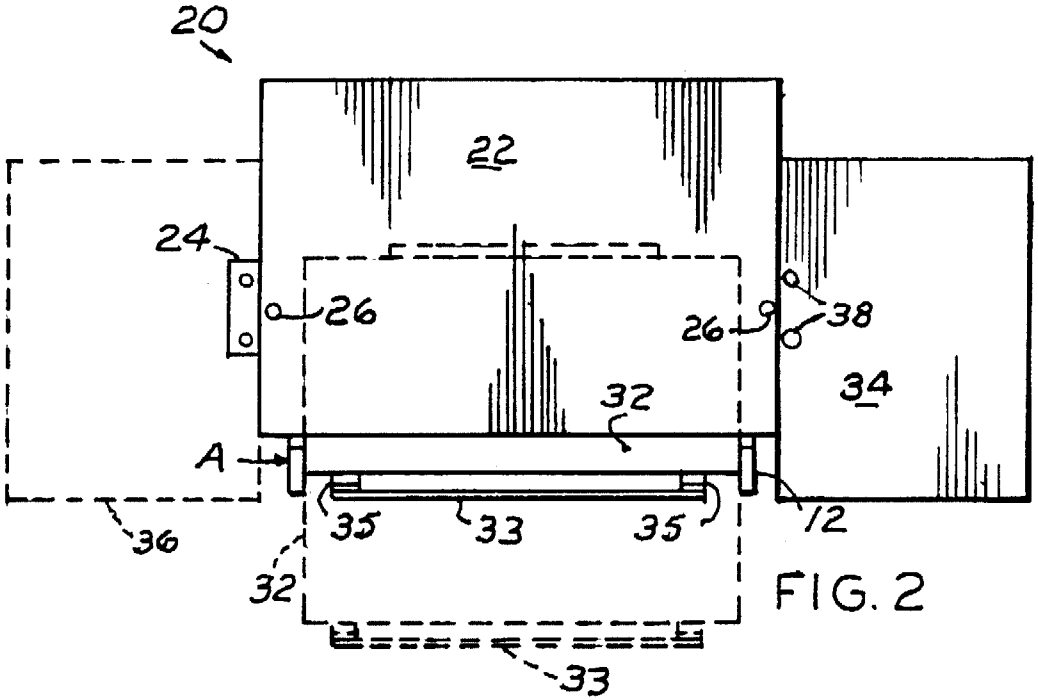
FIG. 2 is a top view, with one mouse pad illustrated by broken lines.
Figure 3:
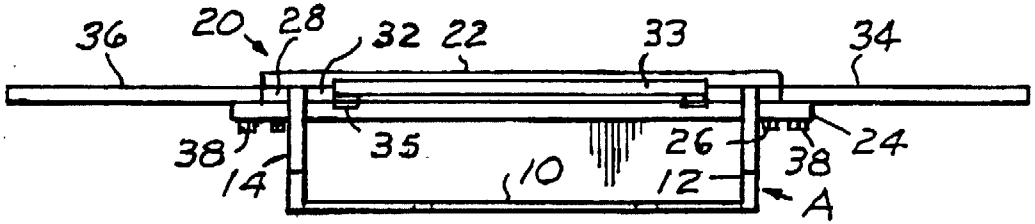
FIG. 3 is a front elevational view of FIG. 2.

Referring also to FIGS. 2, 3, and 4 the stand 20 comprises a monitor supporting platform or top 22 overlying the tray A. A first anchor or clamp plate 24 extends through the side wall openings 19 and projects a selected distance beyond the respective side wall 12 and 14 of the tray. Bolts 26 extending vertically through the top 22 and the plate 24 outwardly of the side walls 12 and 14 secure the top 22 to the tray A. Spacer blocks 28 of equal thickness with the top 22 are interposed between the top 22 and the first plate 24 adjacent the respective side wall 12 and 14 (FIGS. 3, 4, 5 and 7) to prevent bowing the lateral side edges of the top 22 downward. The space between the side walls 12 and 14 and between the top 22 and the plate 24 slidably receives a forwardly extendable keyboard support 32 having a keyboard grab bar 33 secured to its forwardly projecting end surface by brackets 35. Similarly a depending stop 37 secured to the rearward surface of the keyboard support 32 limits its forward movement by contact with the clamp plate 24. Additionally, a pair of mouse pads 34 and 36 each having one side edge overlying the outwardly projecting end edge portions of the clamp plate 24 are secured thereto by two pairs of clamp bolts 38.

Figure 6:
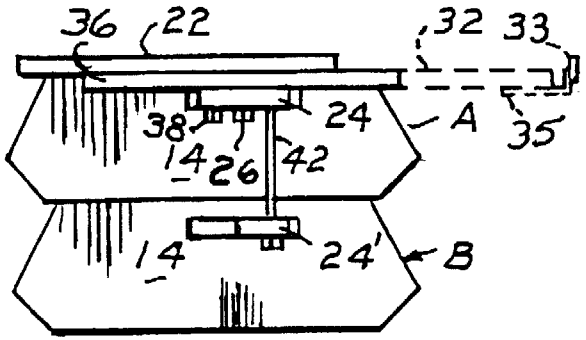
FIG. 6 is a left side elevational view of FIG. 5.
Figure 5:
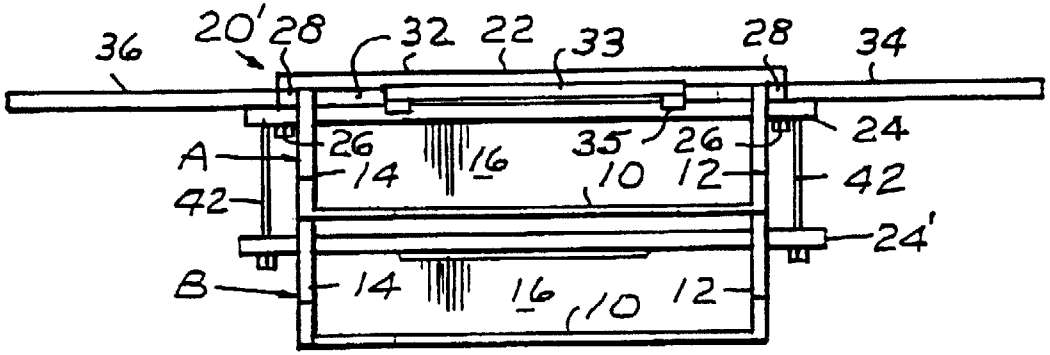
FIG. 5 is a front elevational view of a second embodiment.

Referring now to FIGS. 5 and 6, to further elevate a monitor, a second rectangular clamp plate 24' is extended through the lateral openings 19 of the tray B and the monitor stand 20' is superposed on the tray B with the respective side walls of the two trays in vertical alignment. A pair of elongated anchor bolts 42 replaces one pair of the short clamp bolts 38 and extends vertically through the respective mouse pad, the plate 24 and the plate 24' to connect the trays A and A and B in rigid superposed relation.

Figure 8:
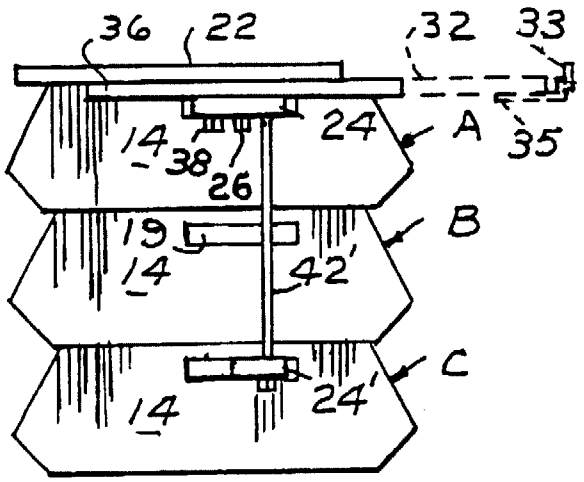
FIG. 8 is a left side elevational view of FIG. 7.
Figure 7:
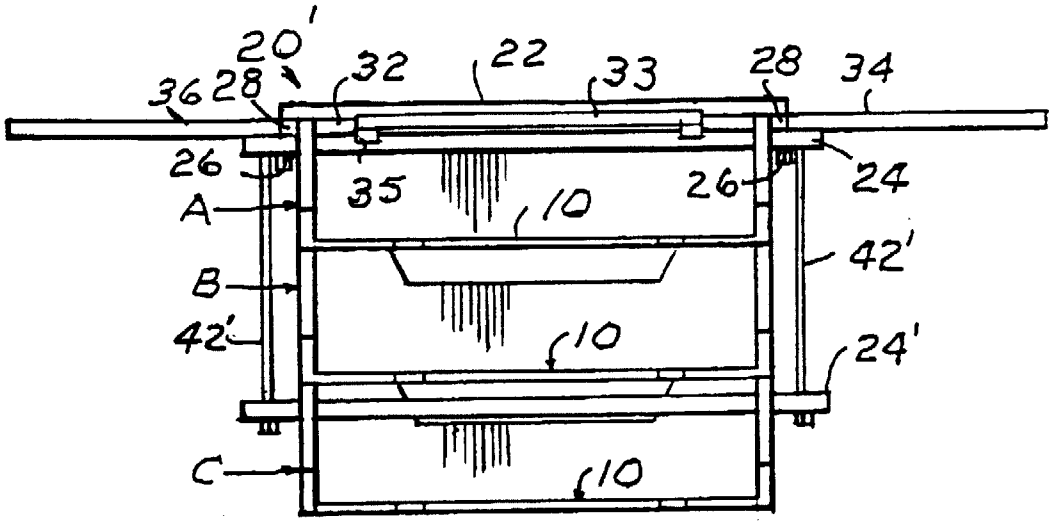
FIG. 7 is a front elevational of a third embodiment.

Referring also to FIGS. 7 and 8, the monitor stand height may be increased further by superposing the stand 20' of FIGS. 4 and 5 on the third tray C. This is accomplished by removing the anchor bolts 42 and inserting the clamp plate 24' into the lateral openings 19 of the tray C and providing other longer anchor bolts 42' for similarly anchoring the plate 24 to the plate 24' and the three trays A, B and C in vertical stacked aligned relation.

Obviously the invention is susceptible to changes or alterations without defeating its practicability. Therefore, I do not wish to be confined to the preferred embodiment shown in the drawings and described herein.

I claim:

1. A computer monitor stand, comprising:

a first tray-like spacer having a horizontal bottom wall integral with opposing side walls and an end wall, said side walls having a horizontal flanged upper surface transversely at least twice the thickness of the respective side wall, said side walls having horizontally aligned transverse openings intermediate their ends;

a platform overlying and projecting beyond the boundaries of said side walls;

a first clamp plate having end portions projecting through the openings;

screw threaded means securing marginal edge portions of said platform with said first clamp plate and impinging a portion of said side walls therebetween;

a computer keyboard support slidably supported by said first clamp plate between said side walls for forward and rearward horizontal movement; and, stop means limiting the movement.

2. The monitor stand according to claim 1 and further including:

a computer rigid mouse pad having a marginal edge portion overlying and secured to an end portion of said first clamp plate adjacent a lateral side of said platform.

3. The monitor stand according to claim 2 and further including:

a second spacer underlying and supporting said first spacer in side wall aligned relation;

a second clamp plate having end portions extending transversely through said second spacer below said first clamp plate; and, other screw threaded means extending through the superposed end portions of said first and second clamp plate and impinging a portion of said first and second spacers therebetween.

4. The monitor stand according to claim 1 and further including:

a second spacer underlying and supporting said first spacer in side wall aligned relation;

a second clamp plate having end portions extending transversely through said second spacer below said first clamp plate; and, other screw threaded means extending through the superposed end portions of said first and second clamp plate and impinging a portion of the walls of said first and second spacers therebetween.

5. A knockdown computer monitor stand, comprising:

a first rectangular spacer having a predetermined thickness between parallel top and bottom surfaces and opposing side walls having a transverse opening, a platform overlying and projecting beyond the boundaries of said top surface;

a first clamp plate having end portions projecting through said side walls;

screw threaded means securing marginal edge portions of said platform with said first clamp plate and impinging a portion of said side walls therebetween;

a computer keyboard support slidably supported by said first clamp plate between said side walls for forward and rearward horizontal movement; and, stop means limiting the movement.

6. The monitor stand according to claim 5 and further including:

a computer rigid mouse pad having a marginal edge portion overlying and secured to an end portion of said first clamp plate adjacent a lateral side of said platform.

7. The monitor stand according to claim 6 and further including:

a second spacer underlying and supporting said first spacer in side wall aligned relation;

a second clamp plate having end portions extending transversely through said second spacer below said first spacer; and, other screw threaded means extending through the superposed end portions of said first and second clamp plate and impinging said first and second spacers therebetween.

8. The monitor stand according to claim 5 and further including:

a second spacer underlying and supporting said first spacer in side wall aligned relation;

a second clamp plate extending transversely through said second spacer; and, other screw threaded means extending through the superposed end portions of said first and second clamp plate and impinging said first and second spacers therebetween.

* * * * *